US006258147B1

(12) United States Patent
Jansson et al.

(10) Patent No.: US 6,258,147 B1
(45) Date of Patent: Jul. 10, 2001

(54) CEMENTED CARBIDE WITH A HARDENABLE BINDER PHASE

(75) Inventors: Bo Jansson, Hägersten; Jan Qvick, Virsbo, both of (SE)

(73) Assignee: Seco Tools AB, Fagersta (SE)

( * ) Notice: Subject to any disclaimer, the term of this patent is extended or adjusted under 35 U.S.C. 154(b) by 0 days.

(21) Appl. No.: 09/487,496

(22) Filed: Jan. 19, 2000

(30) Foreign Application Priority Data

Jan. 29, 1999 (SE) ..... 9900320

(51) Int. Cl.[7] ..... C22C 29/00

(52) U.S. Cl. ..... 75/240; 419/18; 419/25; 419/26; 419/28; 419/29; 419/35; 419/38

(58) Field of Search ..... 75/240; 419/25, 419/26, 28, 29, 35, 38, 18

(56) References Cited

U.S. PATENT DOCUMENTS

| | | | | |
|---|---|---|---|---|
| 3,658,604 | | 4/1972 | Hale . | |
| 4,145,213 | | 3/1979 | Oskarsson et al. . | |
| 5,841,045 | * | 11/1998 | McCandlish et al. | 75/236 |
| 6,024,776 | * | 2/2000 | Heinrich et al. | 75/238 |
| 6,086,650 | * | 7/2000 | Carpenter | 75/240 |

FOREIGN PATENT DOCUMENTS

| | | |
|---|---|---|
| 1 558 494 | 3/1972 | (DE) . |
| 61-096072 | 5/1986 | (JP) . |
| 6-033183 | 2/1994 | (JP) . |

* cited by examiner

*Primary Examiner*—Ngoclan Mai
(74) *Attorney, Agent, or Firm*—Burns, Doane, Swecker & Mathis, L.L.P.

(57) ABSTRACT

The present invention relates to a sintered cemented carbide consisting of 50 to 90 wt-% submicron WC in a hardenable binder phase. The binder phase comprises, in addition to Fe, 10–60 wt-% Co, <10 wt-% Ni, 0.2–0.8 wt-% C, Cr, W, Mo and/or V in amounts satisfying the relations $$2x_C<x_W+x_{Cr}+x_{Mo}+x_V<2.5x_C$$

where x denotes mol fraction elements in the binder phase and the following relation for the total Cr content $$0.03<\text{wt-\% Cr}/(100\text{-wt-\% WC})<0.05$$

In addition, the binder phase consists of martensite with a fine dispersion, a few percent, of coherent carbides, preferably of $M_2C$ type, with a size of the order of 10 nm.

11 Claims, 1 Drawing Sheet

CEMENTED CARBIDE WITH A HARDENABLE BINDER PHASE

BACKGROUND OF THE INVENTION

The present invention relates to a material based on a hardenable binder phase in a submicron WC-based cemented carbide.

It is desirable to develop cutting tool materials with a high wear resistance compared to high speed steel and tougher than cemented carbide. One example of such a material is U.S. Pat. No. 3,658,604, which discloses material containing 15–75 wt-% WC in a matrix of Co and Fe with a ratio Co to Fe of 0.65 to 2.0. Another example is U.S. Pat. No. 4,145,213 which discloses 30–70 vol-% submicron hard constituents in a matrix of high-speed steel type.

OBJECTS AND SUMMARY OF THE INVENTION

It is an object of this invention to avoid or alleviate the problems of the prior art.

It is further an object of this invention to provide a hard material based on submicron WC in a hardenable binder phase.

It is yet further an object of this invention to provide a material with a balanced binder phase composition and hardening temperature. An efficient precipitation of secondary carbides requires a good balance between carbide formers and carbon dissolved in the hardened binder phase.

In one aspect of the invention there is provided a cemented carbide consisting of 50 to 90 wt-% submicron WC in a hardenable binder phase wherein said binder phase comprises, in addition to Fe, 10–60 wt-% Co, <10 wt-% Ni, 0.2–0.8 wt-% C, Cr, W, Mo and/or V in amounts satisfying the relations $$2x_C<x_W+x_{Cr}+x_{Mo}+x_V<2.5x_C$$

where x denotes mol fraction elements in the binder phase and the following relation for the total Cr content $$0.03<\text{wt-\% Cr}/(100\text{-wt-\% WC})<0.05$$

In another aspect of the invention there is provided a method of making a cemented carbide consisting of 50 to 90 wt-% submicron WC in a hardenable binder phase by powder metallurgical methods, milling, pressing and sintering of powders forming hard constituents and binder phase wherein said binder phase comprises, in addition to Fe, 10–60 wt-% Co, <10 wt-% Ni, 0.2–0.8 wt-% C, Cr, W, Mo and/or V in amounts satisfying the relations $$2x_C<x_W+x_{Cr}+x_{Mo}+x_V<2.5x_C$$

where x denotes mol fraction elements in the binder phase and the following relation for the total Cr content $$0.03<\text{wt-\% Cr}/(100\text{-wt-\% WC})<0.05$$

sintering is performed in the temperature range 1230–1350° C. and the sintered cemented carbide is solution treated at 1000–1150° C. for about 15 min in a protective atmosphere, force cooled from the solution temperature, heat treated one or more times at 500–650° C. for about 1 h followed by forced cooling.

BRIEF DESCRIPTION OF THE DRAWINGS

The Figure shows a SEM micrograph of a material according to the present invention, magnification X10000.

DETAILED DESCRIPTION OF THE PREFERRED EMBODIMENTS OF THE INVENTION

Figure 1:
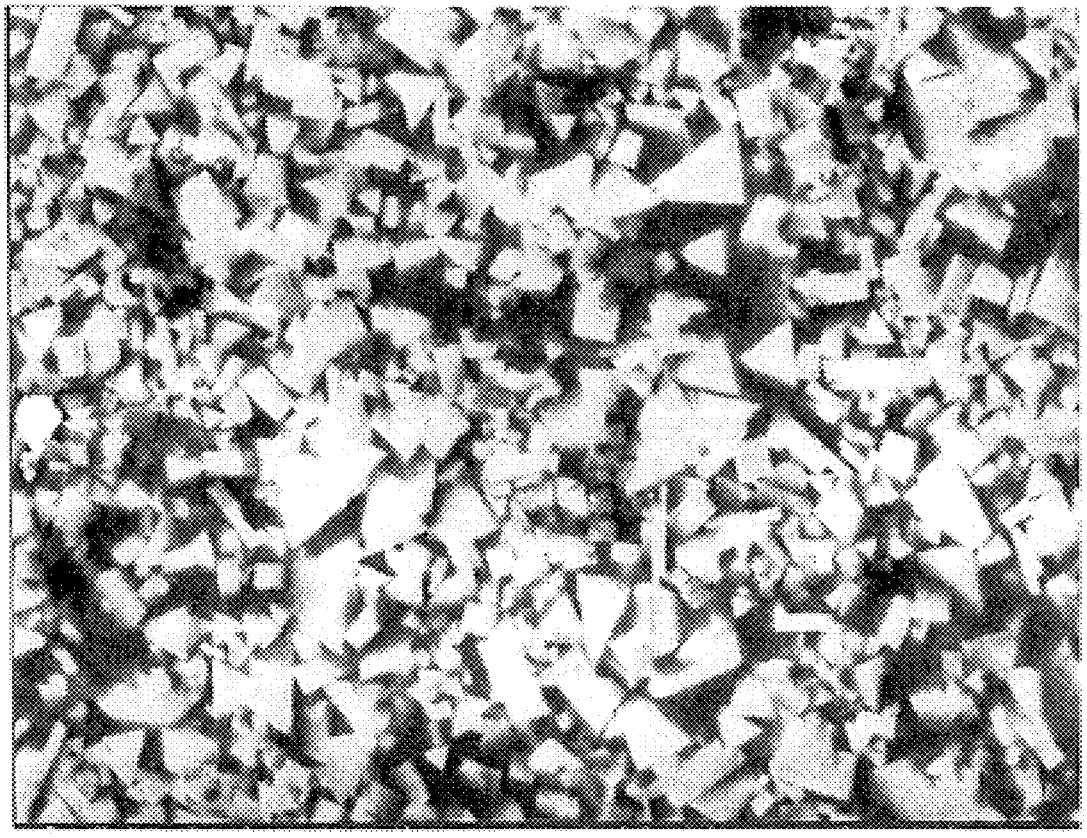

The material according to the present invention comprises 50 to 90 wt-% WC, preferably 60 to 75 wt-% WC, in a hardenable (martensitic) matrix. The WC has an average grain size of <0.8 μm, preferably <0.4 μm, with essentially all grains <1 μm. The hardenable binder phase contains Fe, Co and Ni with a Co content of 10–60 wt-% and a Ni content of <10 wt-%, preferably >0.5 wt-%. Further, the binder phase in addition to dissolved W must contain Cr and possibly Mo and/or V. The amount of dissolved W, Cr and Mo in the binder phase must balance the dissolved C at the hardening solution temperature such that $$2x_C<x_W+x_{Cr}+x_{Mo}+x_V<2.5x_C$$

where x denotes mol fraction elements in the binder phase. The carbon content of the binder phase must be 0.2–0.8 wt-% C, preferably 0.3–0.7 wt-% C. These requirements result in the following relation for the total Cr content of the material.

$$0.03<\text{wt-\% Cr}/(100\text{-wt-\% WC})<0.05$$

The hardened binder phase comprises a martensitic matrix with a fine dispersion, a few percent, e.g., preferably more than 5%, of coherent carbides, preferably of $M_2C$ type, with a size of the order of 10 nm. The martensitic structure is body centered tetragonal (bct) and may contain up to 20 vol-% of face centered cubic metallic phase (fcc).

In a first preferred embodiment, the material contains a binder phase with 10–15 wt-% Co. The C content should be adjusted such that minor amounts of $M_6C$ carbide is formed, 2–5 vol-%, less than 10 μm in size.

In a second preferred embodiment, the material contains a binder phase with 45–55 wt-% Co. This embodiment avoids formation of $M_6C$ carbides and other undesired phases such as graphite. $M_{23}C_6$, $M_7$, $C_3$, $M_3C_3$, etc. The martensite formed in this embodiment is ordered which provides a further increase in hardness.

In a third preferred embodiment, the material contains a binder phase with 5–10 wt-% Ni. This results in a precipitation of nanosize Ni-rich metallic fcc particles simultaneously with the carbide precipitation. Presence of the fcc particles, preferably 10–25 vol-%, significantly increases the toughness but somewhat decreases the hardness.

The material according to the present invention is made by conventional powder metallurgical methods, milling, pressing and sintering. Suitable amounts of powders forming hard constituents and binder phase are wet milled, dried, pressed to bodies of desired shape and dimension and sintered.

The sintering is performed in the temperature range 1230–1350° C., preferably in vacuum. The first preferred embodiment requires an isothermal hold at about 1180° C. for 2 h to form $M_6C$ carbides of a desired size followed by sintering at a temperature where the binder phase is partially melted, 1230–1250° C., to avoid formation of too large $M_6C$ particles. The second and third preferred embodiments can be sintered at temperatures where the binder phase is completely melted, 1280–1350° C.

After sintering, the material is heat-treated. The material is solution treated in the range 1000–1150° C., where the binder phase has a faced centered cubic structure for about 15 min in protective atmosphere to dissolve carbide formers and some further W in the binder phase. The cooling from the solution temperature must be forced at a rapid temperature for from about 10 to 100° C./sec in order to obtain a martensitic transformation, e.g., by oil quenching or similar. Finally, the material is heat treated one or more times in the range 500–650° C. for about 1 h followed by forced cooling. The purpose of the final heat treatment is to obtain a dispersion of nanosized carbides of $M_2C$ or MC type and to control the amount of retained face centered cubic phase.

Inserts according to the invention can be coated with thin wear resistant layers of known metal oxides, nitrides, carbides and mixtures thereof according to known CVD or PVD techniques, preferably PVD technique.

The invention is additionally illustrated in connection with the following Examples which are to be considered as illustrative of the present invention. It should be understood, however, that the invention is not limited to the specific details of the Examples.

EXAMPLE 1

From a powder mixture comprising 31.4 wt-% Fe (BASF Iron CS), 4.8 wt-% Co (OMG Cobalt Extra Fine), 1.8 wt-% $Cr_3C_2$ (H.C. Starck), 61.6 wt-% WC (HC Starck DS 80—grain size 0.8 μm) and 0.4 wt-% W turning inserts of type SNUN 120412 were pressed. The inserts were sintered with flowing $H_2$ up to 450° C. for dewaxing, further in vacuum up to 1180° C. with a 2 h hold followed by sintering at 1240° C. for 1 h.

The hardness after furnace cooling was 797 HV10. The samples were held at 1100° C. for 15 minutes and then quenched in oil resulting in a hardness of 1035 HV10. Double tempering, 1 h at 550° C., increased the hardness further to 1058 HV10.

EXAMPLE 2

From a powder mixture comprising 15.4 wt-% Fe (BASF Iron Cs), 15.4 wt-% Co (OMG Cobalt Extra Fine), 1.8 wt-% $Cr_3C_2$ (H.C. Starck), 67.3 wt-% WC (Dow Chemicals Super-Ultrafine—grain size 0.2 μm) and 0.1 wt-% carbon black turning inserts of type SEAN 1203 AFN were pressed. The inserts were sintered with flowing $H_2$ up to 450° C. for dewaxing, further in vacuum up to 1180° C. with a 2 h hold followed by sintering at 1350° C. for 1 h. See the Figure.

The hardness after furnace cooling was 1088 HV10. The samples were held at 1080° C. for 15 minutes and then quenched in oil resulting in a hardness of 1216 HV10. Double tempering, 1 h at 550° C., increased the hardness further to 1289 HV10.

EXAMPLE 3

The SEAN 1203AFN inserts of Example 2 were ground and coated with a 3 μm thick TiN layer according to known PVD technique. Inserts of the same geometry with a high speed steel substrate (Alesa) and a submicron cemented carbide, WC+13 wt-% Co, substrate (Seco Tools F40M) were coated in the same batch.

With the SEAN 1203AFN inserts, single tooth milling tests were performed in an ordinary low carbon steel. The following data were used:

Speed 125 m/min

Feed 0.05 mm/rev

Cutting Depth 2.0 mm

The average lifetime for the high speed steel insert was 3 min, for the insert according to the invention, Example 2, 17 min and for the cemented carbide insert, 40 min.

EXAMPLE 4

From a powder mixture comprising 13.0 wt-% Fe (BASF Iron CS), 11.3 wt-% Co (OMG Cobalt Extra Fine), 1.9 wt-% Ni (INCO), 1.2 wt-% $Cr_3C_2$ (H. C. Starck), 72.0 wt-% WC (Dow Chemical Super-Ultrafine—grain size 0.2 μm) and 0.6 wt-% C turning inserts of type SNUN 120412 were pressed. The inserts were sintered with flowing $H_2$ up to 450° C. for dewaxing, further in vacuum up to 1180° C. with a 2 h hold followed by sintering at 1300° C. for 0.5 h.

The hardness after furnace cooling was 1270 HV10. The samples were held at 1100° C. for 15 minutes and then quenched in oil resulting in a hardness of 1336 HV10. After double tempering, 1 h at 560° C., 600° C., and 640° C., the hardness was 1351 HV10, 1294 HV10 and 1244 HV10, respectively.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cemented carbide consisting of 50 to 90 wt-% submicron WC in a hardenable binder phase wherein said binder phase comprise, in addition to Fe, 10–60 wt-% Co, <10 wt-% Ni, 0.2–0.8 wt-% C., Cr, W, Mo and/or V in amounts satisfying the relations $$2x_C<x_W+x_{Cr}+x_{Mo}+x_V<2.5x_C$$

where x denotes mol fraction elements in the binder phase and the following relation for the total Cr content $$0.03<\text{wt-\% Cr}/(100-\text{wt-\% WC})<0.05$$

2. The cemented carbide of claim 1 wherein the binder phase contains martensite with a fine dispersion of coherent carbides with a size of 10 nm.

3. The cemented carbide of claim 2 wherein the martensite is a body centered tetragonal and contains up to 20 vol-% of face centered cubic metallic phase.

4. The cemented carbide of claim 3 wherein the dispersion is of an $M_2C$ carbide.

5. The cemented carbide of claim 1 wherein the binder phase contains 10–15 wt-% Co and 2–5 vol-% $M_6C$ carbide <10 μm in size.

6. The cemented carbide of claim 1 wherein the binder phase contains 45–55 wt-% Co, is free from $M_6C$, $M_{23}C_6$, $M_7C_3$, $M_3C_2$ with ordered martensite.

7. The cemented carbide of claim 1 wherein the binder phase contains 5–10 wt-% Ni with nanosize Ni-rich metallic fcc particles.

8. The cemented carbide of claim 7 wherein the nanosize Ni-rich metallic fcc particle are present in an amount of 1–25 vol-%.

9. A method of making a cemented carbide consisting of 50 to 90 wt-% submicron WC in a hardenable binder phase, wherein the method comprises: milling, pressing and sintering of powders forming hard constituents and binder phase wherein said binder phase comprise, in addition to Fe, 10–60 wt-% Co, <10 wt-% Ni, 0.2–0.8 wt-% C, Cr, W, Mo and/or V in amounts satisfying the relations $$2x_C<x_W+x_{Cr}+x_{Mo}+x_V<2.5x_C$$

where x denotes mol fraction elements in the binder phase and the following relation for the total Cr content $$0.03<\text{wt-\% Cr}/(100-\text{wt-\% WC})<0.05$$

sintering is performed in the temperature range 1230–1350° C. and the sintered cemented carbide is solution treated at 1000–1150° C. for about 15 min in protective atmosphere, force cooled from the solution temperature, heat treated one or more times at 500–650° C. for about 1 h followed by forced cooling.

10. The method of claim 9 wherein in an isothermal hold at about 1180° C. for 2 h is followed by sintering at a temperature where the binder phase is partially melted, 1230–1250° C.

11. The method of claim 9 wherein the sintering is at a temperature of 1280–1350° C.

* * * * *